US005372197A

United States Patent [19]

Wacker

[11] Patent Number: 5,372,197

[45] Date of Patent: Dec. 13, 1994

[54] TUBING UNLOADER APPARATUS AND METHOD

[75] Inventor: Samuel L. Wacker, Roosevelt, Utah

[73] Assignee: GCW Development, Bluebell, Utah

[21] Appl. No.: 68,426

[22] Filed: May 27, 1993

[51] Int. Cl.[5] ..... E21B 37/00

[52] U.S. Cl. ..... 166/311; 166/373; 166/331

[58] Field of Search ..... 166/304, 331, 240, 317, 166/373, 311

[56] References Cited

U.S. PATENT DOCUMENTS

| | | | |
|---|---|---|---|
| 3,385,371 | 5/1968 | Berryman | 166/331 |
| 3,610,337 | 10/1971 | Lewis | 166/331 |
| 4,333,530 | 6/1982 | Armstrong | 166/331 |
| 4,391,326 | 7/1983 | Greenlee | 166/240 |
| 4,590,998 | 5/1986 | Hopper | 166/331 |
| 4,637,471 | 1/1987 | Soderberg | 166/373 |
| 4,640,363 | 2/1987 | Taylor | 166/317 |
| 4,909,326 | 3/1990 | Owen | 166/317 |
| 4,944,349 | 7/1990 | Van Gonten, Jr. | 166/304 |

*Primary Examiner*—Ramon S. Britts

*Assistant Examiner*—Frank S. Tsay

*Attorney, Agent, or Firm*—J. Winslow Young

[57] ABSTRACT

A tubing unloader for draining liquid from production tubing in an oil well. The tubing unloader has a hollow throughbore so as to form a part of the production tubing until it is necessary to drain the production tubing. The tubing unloader has two basic parts which telescopically cooperate to close or open drain holes in the tubing unloader. The bottom portion of the tubing unloader is a hollow cylinder configured as an outer mandrel body having a pair of J-slots formed on an internal surface. The top portion of the tubing unloader is a hollow cylinder configured as an inner mandrel having a pair of J-lugs protruding from its external surface. The inner mandrel includes a sliding valve and is telescopically received in the outer mandrel body in slide fit relationship with the J-lugs slidingly engaged in the J-slots. Selective manipulation of the tubing unloader allows the operator to drain the production tubing as well as to impart sharp, downwardly or upwardly directed forces on the tubing unloader as a mechanism for releasing a tubing anchor.

10 Claims, 10 Drawing Sheets

TUBING UNLOADER APPARATUS AND METHOD

BACKGROUND

1. Field of the Invention

This invention relates to tubing unloaders for production tubing in an oil well and, more particularly, to a novel tubing unloader in combination with a free point and a mechanical bumper sub that provides the operator with the capability to produce jarring forces on the production tubing in both the downward and upward directions.

2. The Prior Art

Production of crude oil from a completed, low pressure oil well is accomplished by inserting a production string into the well. The production string includes a bottom hole assembly consisting of a tail pipe with a gas buster, tubing anchor, seating nipple, and a rod pump. The rod pump is seated in the seating nipple. The rod pump is stroked by a mechanical rod known as a sucker rod which passes upwardly through the production tubing to a surface pump drive unit known as a "pump jack" or "horsehead pump" so named because of the shape of the lever arm of the pump drive unit. The production tubing carries the crude oil to the surface.

The tubing anchor is the bottom element of the production string and functions to releasably secure the bottom of the production tubing to the internal wall surface of the casing. The purpose of the tubing anchor is to allow for the application of tension on the production string. This tension is necessitated by the pumping action because the sucker rod reciprocates up and down inside the production tubing. On each upstroke an unanchored production tubing will move upwardly (breathing) as the fluid load inside the production tubing is transferred from the production tubing to the sucker rod. Further, the production tubing, for several joints above the rod pump, will be forcibly wrapped around the taut sucker rod string (buckling) causing excessive wear on the sucker rod and the production tubing with an accompanying increased friction drag along with a corresponding increase in the surface power requirements. These actions also severely reduce the effectiveness of the rod pump at each stroke and cause couplings in the production tubing to rub against the casing with resulting coupling wear. Ultimately, unless corrected, leakage occurs, or the production tubing and/or sucker rod will part resulting in substantial production losses.

From the foregoing, it is clear that the tubing anchor must be firmly set in the casing to assure that the production tubing is properly anchored. Once properly anchored, a predetermined tensile force is applied to the production tubing to preclude the foregoing breathing and buckling actions. Release of a conventional tubing anchor is customarily achieved by the application of a predetermined amount of set down weight coupled with a simultaneous rotation of the production tubing in the right hand direction. In the event normal release procedures fail, emergency shear release can be obtained by imposing a large, upwardly directed pull force against the production tubing.

A known problem of submersible pumps of this type is excessive wear due to sand and/or clogging from the sand and other debris that accumulates in the rod pump over time. A worn or stuck rod pump can result in a break in the sucker rod which will necessitate the sucker rod being fished and brought to the surface along with the rod pump. Desirably, the sucker rod would separate at or adjacent the rod pump. However, on many occasions the rod pump will not unseat out of the seating nipple. This condition is referred to as a stuck pump. Under this circumstance the sucker rod would be backed off and tripped out of the hole.

Customarily, the production tubing is filled with crude oil as a result of the pump stoppage occurring during operation. This condition is known as a "wet" production tubing. It is undesirable to pull a wet production tubing for several reasons. First, of course, a wet production tubing is extremely heavy requiring correspondingly heavy surface equipment to pull the production string. However, safety is probably the major reason why it is desirable to drain the production tubing prior to its being pulled from the oil well. Spilled crude oil resulting from pulling a wet production tubing represents a fire hazard and as well as a health and an environmental hazard.

One solution is to insert a tubing unloader in the production tubing one or two tubing lengths above the rod pump. One such device is shown in U.S. Pat. No. 4,903,326. This device incorporates externally located J-slots with shearable pins cooperating in the J-slots. The pins are designed to be sheared under emergency conditions. However, in the event the pins are sheared, a portion of the tubing unloader will be left in the well necessitating a major fishing job to retrieve the remainder of the tubing unloader, the lower tubing lengths, the rod pump, and the tubing anchor.

In view of the foregoing, it would be an advancement in the art to provide a tubing unloading apparatus and method whereby a wet production tubing can be readily and easily drained while at the same time incorporating in the tubing unloading apparatus a mechanism to enable the operator to selectively impart a downward jarring force as well as an upward jarring force on the tubing string. It would also be an advancement in the art to provide a tubing unloading tool having no shearing mechanism thereby effectively precluding the tool from being deliberately or even inadvertently sheared. Such a novel invention is disclosed and claimed herein.

BRIEF SUMMARY AND OBJECTS OF THE INVENTION

The tubing unloader of this invention provides a simple, fail-safe device for draining crude oil from a wet production tubing whenever the tubing is filled with crude oil resulting from a stuck pump, stuck valve, or the like. The tubing unloader also provides the operator with a free stroke or free movement over a known distance. This is referred to in the art as the free point which allows the operator to use the tubing unloader selectively to impose a jarring action on the tubing string in either the downward or the upward direction. A J-slot mechanism allows the tubing unloader to be operated between the open and closed positions as well as to transmit torque across the tubing unloader.

It is, therefore, a primary object of this invention to provide improvements in tubing unloaders.

Another object of this invention is to provide improvements in the method of unloading a wet production tubing.

Another object of this invention is to provide improvements in the method of imposing axially directed forces on the bottom hole assembly.

Another object of this invention is to provide a tubing unloader having a predetermined free stroke to allow the operator to selectively jar the bottom hole assembly with either an upwardly directed force or a downwardly directed force.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
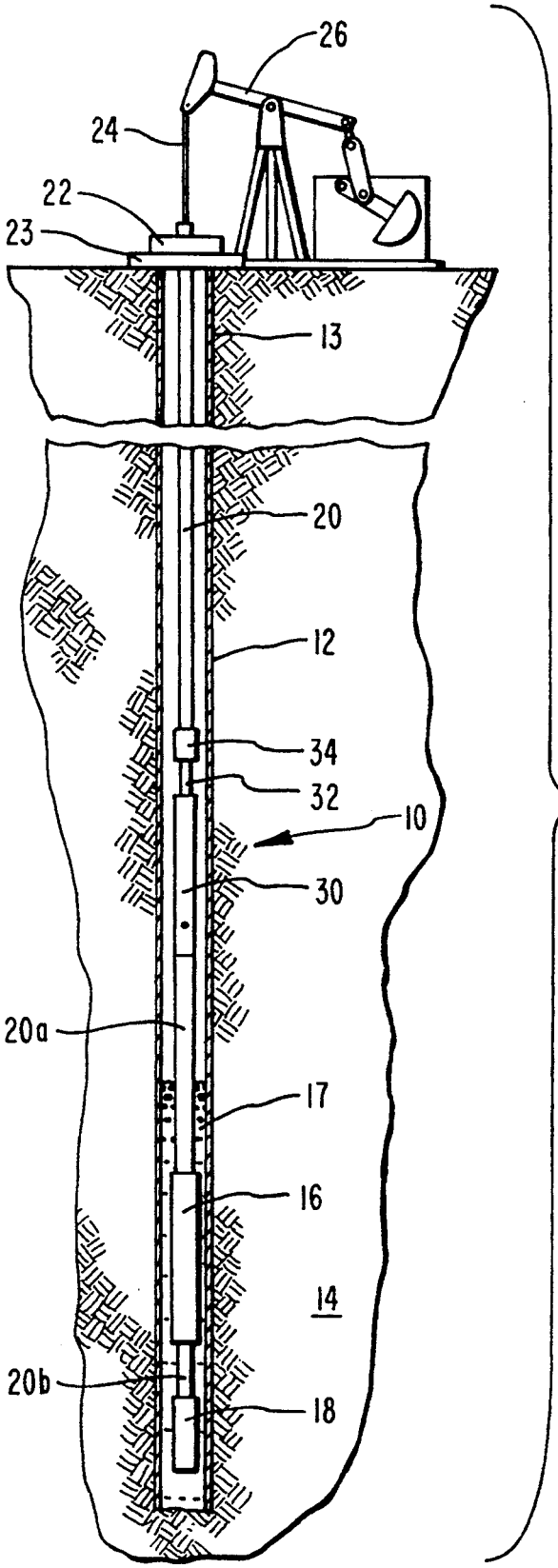
FIG. 1 is a schematic diagram illustrating the tubing unloader of this invention in position in a producing oil well.

The invention is best understood by reference to the drawing wherein like parts are designated by like numerals throughout in conjunction with the following description.

General Discussion

Commencing from the upper end of the tubing unloader of this invention, the top most element is a knocker sub. The knocker sub connects the tubing unloader to the lower end of that particular length of production tubing. The knocker sub is affixed to the upper end of an inner mandrel which slidingly and telescopically cooperates inside an outer mandrel body. The relative orientation of the inner mandrel inside the outer mandrel body is controlled by a J-slot sleeve secured in a recess in the upper end of the outer mandrel body. J-lugs on the outer surface of the inner mandrel slidingly cooperate in the J-slots. The J-slot sleeve and the inner mandrel are secured to the outer mandrel body by a top sub which also acts as an anvil against which both the knocker sub and the J-lugs impact, depending upon whether the impact force is directed in a downward or an upward direction, respectively.

The lower end of the inner mandrel has mounted thereto a sliding valve assembly to selectively seal off the drain holes in the outer mandrel body. A scale scraper is included on the end of the sliding valve assembly to clear away any scale or debris accumulation that may interfere in the operation of the tubing unloader. The bottom of the outer mandrel body is coupled to the remainder of the production tubing below the tubing unloader by a bottom sub.

The tubing unloader is designed to be run in the closed position at a location about 30 feet above the top stroke of the rod pump. The tubing unloader is designed with an inner mandrel that is telescopically received in an outer mandrel body. The inner mandrel is operable to slidingly cooperate in the outer mandrel body to provide about 20 inches of free movement or free stroke. This free movement is also referred to in the industry as the free point. The free point provides the operator with the exact weight of the production string at the tubing unloader thereby providing a reference point from which the tubing anchor can be rebased. This free stroke also allows the operator to selectively impart an axial jarring force on the tubing string in either the upward or the downward direction. The J-lugs on the inner mandrel transmit the upwardly directed force against the under surface of a top sub while the top surface of the top sub acts as an anvil and is struck by the knocker sub to transmit the downwardly directed forces.

The J-lugs slidingly cooperate in diametrally opposed, inwardly oriented J-slots formed in a J-slot sleeve secured in an inner recess in the outer mandrel body. The relative position of the J-lugs in the J-slots determines the functional capability of the tubing unloader. When each J-lug is in the upper end of the short arm of each J-slot the tubing unloader and, more particularly, the sliding valve assembly is in the closed position for normal operation of the rod pump. The tubing unloader is opened by reducing the tension on the production tubing to allow the J-lugs to be moved down the shorter arms of the J-slots until the production tubing can be turned incrementally to the right to bring the J-lugs into alignment with the longer legs of the J-slots at which time the production tubing is then raised to pull the J-lugs to the top of the legs of the J-slots. In this latter position the sliding valve assembly is moved away from the drain holes. Crude oil is then allowed to drain from the production tubing into the annular space between the casing and the production tubing.

The ability to provide longitudinal movement of the J-lugs in the respective legs of the J-slots provides the tubing unloader with the foregoing free stroke. This free stroke provides the operator with the ability to determine exactly the weight to be applied to the production tubing in order to actuate the release mechanism of the tubing anchor. Further, even through there is a certain amount of longitudinal free travel, the J-lugs provide a positive interlock in the J-slots to accommodate the application of torsional forces through the tubing unloader.

On occasion, one will encounter a tubing anchor that is stuck for whatever reason whether compacted with sand, corroded shut, or the like. Previously, it has been the practice to exert an overpull force on the tubing anchor in hopes that the tubing anchor can be sheared. Customarily, the shear point for the tubing anchor will be set at 50,000 pounds pulling force above the weight of the production tubing at the tubing anchor. In the absence of the present invention, failure of the tubing anchor to release at this point in the procedure results in a major fishing job.

My novel tubing unloader is specifically designed to solve this particular problem. Utilizing the 20 inch free stroke available through the free movement of the J-lugs in the legs of the J-slots the operator is able to pick up the production tubing to the upper limit of the 20 inch free stroke and then impose an additional upwardly directed pulling force of, say, 10,000 pounds. By sharply dropping the production tubing down hard, the bottom of the knocker sub strikes the top or anvil of the top sub creating a hard downward blow against the tubing anchor. This downward jarring action can be repeated several times sequentially or alternated with an upward jarring force.

The upward jarring force is created by taking advantage of the limited elasticity found in the extended length of production tubing extending down the oil well. An upward jarring force is ereated by pulling the production tubing to the top of the 20 inch free stroke and then pulling an additional 10,000 pounds tensile force on the production tubing. The production tubing stretches within its elastic limit and the production tubing is marked at this point. An additional stretching force of 20,000 pounds is then imposed on the production tubing thereby raising the mark above its previous position. The operator then drops the production tubing catching it at the mark. The initial drop (release of the 20,000 pound overpull) followed by the catch sequence transmits a force downwardly through the production tubing. The catch at the mark coupled with the inherent elasticity and weight of the production tubing along with the initial 10,000 pound stretch of the production tubing causes the production string to stretch into the free point and then rebound to create a sharp, upward blow by the J-lugs against the base of the top sub.

Detailed Description

Referring now more particularly to FIG. 1, the novel tubing unloader of this invention is shown generally at 10 and includes an outer mandrel body 30, an inner mandrel 32, and a knocker sub 34, the features and functions of each of which will be discussed more fully hereinafter. Tubing unloader 10 is shown interposed as an integral part of a production tubing 20 in an oil well 13 cased with a casing 12. Tubing unloader 10 is incorporated in production tubing 20 at a predetermined distance above a rod pump 16. This predetermined distance is about 30 feet above the top stroke of rod pump 16 which distance is designated by production tubing section 20*a*. This predetermined distance is generally achieved with two lengths of production tubing 20. Rod pump 16 is submersed in crude oil 17 and is held in place in casing 12 by tubing anchor 18 at the end of a tail pipe 20*b*. A tubing hanger 22 at wellhead 23 supports production tubing 20 in casing 12 or, more particularly, cooperates with tubing anchor 18 to place production tubing 20 under the predetermined degree of tension for the reasons stated hereinbefore. A sucker rod 24 extends downwardly from a pump actuator 26 through production tubing 20 into mechanical linkage with rod pump 16.

During normal pumping operation pump actuator 26 reciprocatingly moves sucker rod 24 to thereby impart a corresponding reciprocatory motion in rod pump 16. Rod pump 16 is a conventional rod pump commercially available and widely used throughout the oil production industry. Crude oil 17 is pumped from the surrounding production zone 14 and upwardly through production tubing 20. Crude oil 17 is then directed into the appropriate storage or transshipment system (not shown). Rod pump 16 is generally subjected to certain harsh conditions such as mechanical abrasion from sand or grit entering with crude oil 17 from production zone 14 or chemical corrosion due to the presence of water and/or acidic conditions in crude oil 17 such as from hydrogen sulfide. These harsh conditions will, over time, cause rod pump 16 to lose effectiveness or to even plug, become stuck or otherwise fail completely.

Failure of rod pump 16 necessitates removal of rod pump 16 from production tubing 20 so that it can be brought to the surface for servicing or replacement. The first step is for the operator (not shown) to bring a workover rig (not shown) to well head 23 and remove sucker rod 24 from production tubing 20. Production tubing 20 is then secured by the workover rig and tubing hanger 22 removed to enable the operator to manipulate production tubing 20. The next step is to actuate tubing unloader 10 as will be discussed more fully hereinafter in order to drain crude oil 17 from production tubing 20. Tubing anchor 18 is then released by applying the predetermined set down load on tubing anchor 18 by reducing the amount of tension on production tubing 20 until the set down load has been applied to tubing anchor 18. In the event the application of the set down load fails to cause tubing anchor 18 to release, the operator can create both a down jar and an up jar against tubing anchor 18.

The down jar is created by pulling upwardly on production tubing 20 using the free stroke available in tubing unloader 10. The operator raises production tubing 20 through this free stroke distance and then pulls an additional force of, say, 10,000 pounds. The operator then suddenly releases the tension on production tubing 20. This sudden release of production tubing 20 coupled with the 10,000 pound overpull operating through the free stroke distance in tubing unloader 10 creates a sharp, downwardly directed force against tubing anchor 18.

A sharp, upwardly directed force is created on tubing unloader 10 (and, hence, tubing anchor 18) by pulling production tubing 20 to the top of the foregoing free stroke. A 10,000 pound force is then pulled on production tubing 20 and production tubing 20 is marked at that point. An additional stretching force of 20,000 pounds is then pulled on production tubing 20. Due to the inherent elasticity of production tubing 20, the mark on production tubing 20 is raised above its original position. Production tubing 20 is then dropped and caught at the mark. None of these forces are sufficient to exceed the elastic limit of production tubing 20 with the result that production tubing 20 reacts within its elastic limit. The sudden release of the 20,000 pound overpull coupled with the force of gravity will cause production tubing 20 to stretch downwardly into the free stroke region of tubing unloader 10 and then sharply rebound upwardly under the original pulling force of 10,000 pounds to create a sharp, upwardly directed stroke in tubing unloader 10.

Figure 2:
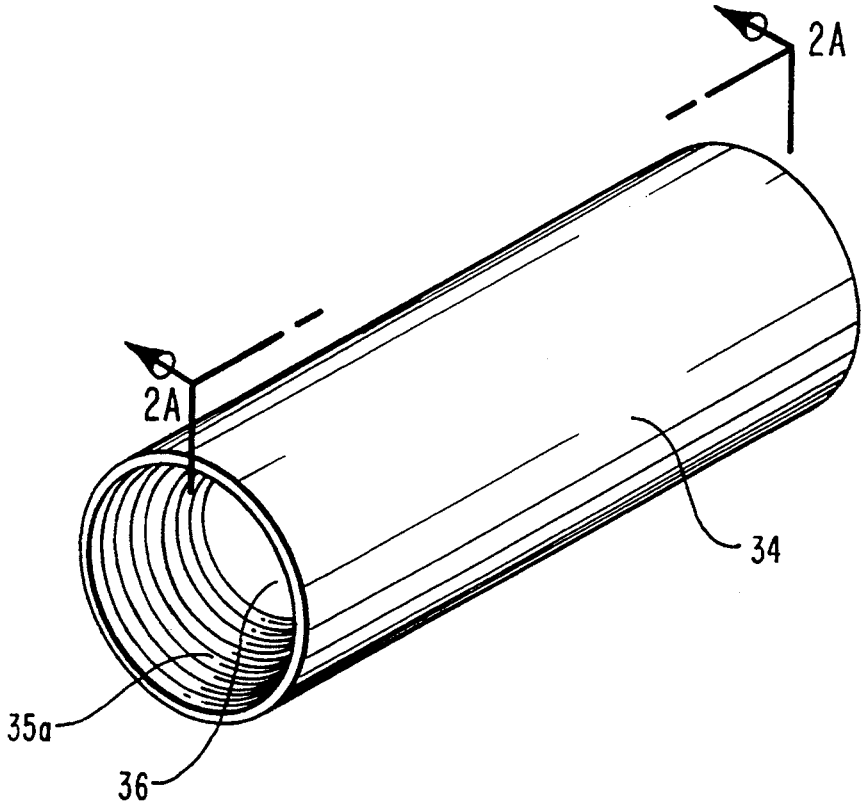
FIG. 2 is a perspective view of the knocker sub that forms the upper end of the novel tubing unloader of this invention and provides the coupler for coupling the upper end of the tubing unloader to the production tubing.
Figure 2A:
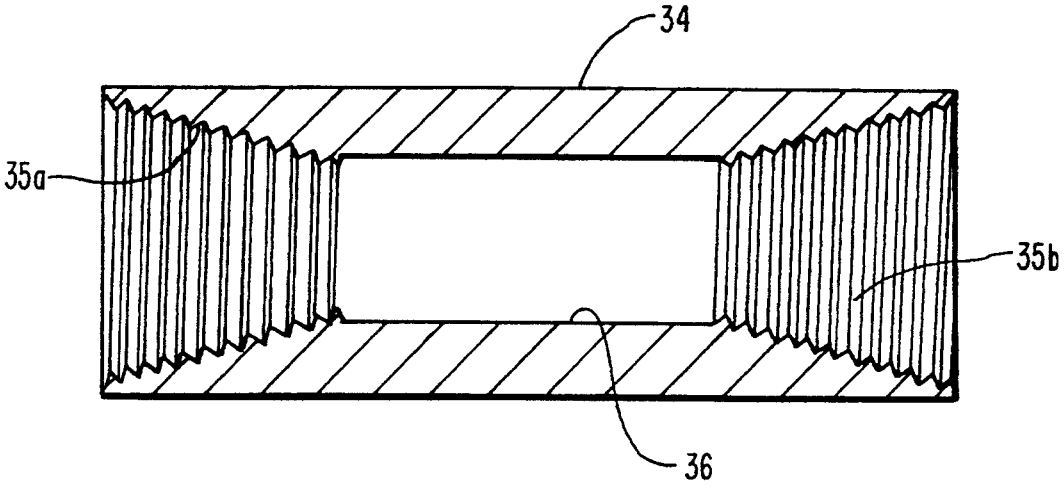
FIG. 2A is a cross-sectional view of the knocker sub taken along lines 2A—2A of FIG. 2.

Referring now to FIGS. 2 and 2A, knocker sub 34 is shown as a hollow, tubular element having a throughbore 36 and a set of tapered, female threads 35*a* and 35*b* at each end. These threaded portions are known in the industry as box end threads 35*a* and 35*b*. The leading face 38 at box end threads 35*b* provides a hammer head for striking the corresponding anvil 51 formed as the face of top sub 50 (FIGS. 4 and 4A) during the previously mentioned down-jar action.

Figure 3:
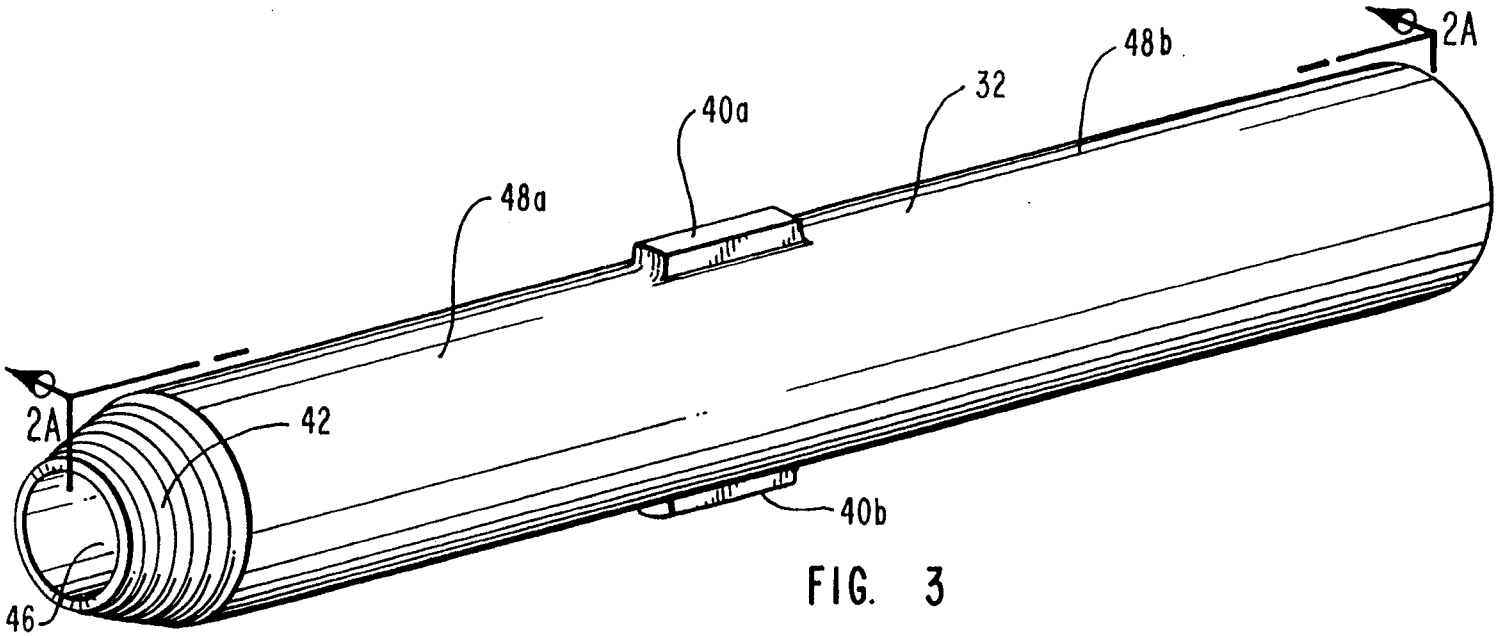
FIG. 3 is a perspective view of the inner mandrel of the tubing unloader.
Figure 3A:
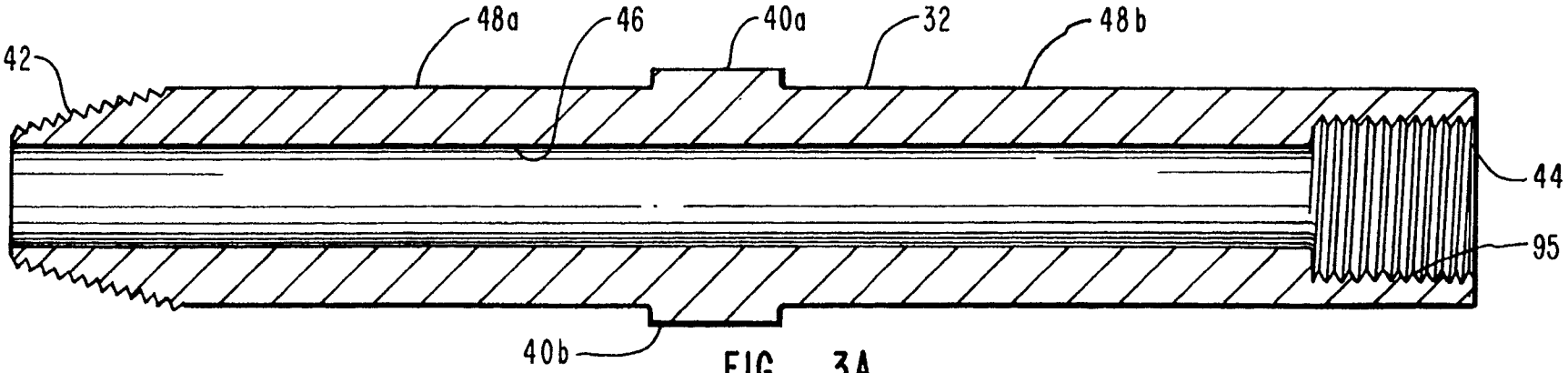
FIG. 3A is a cross-sectional view of the inner mandrel taken along lines 3A—3A of FIG. 3.

Referring now to FIGS. 3 and 3A, inner mandrel 32 is shown as fabricated from a length of tubing that has been machined exteriorly leaving a pair of diametrically opposed J-lugs 40*a* and 40*b* extending outwardly from the external surface of inner mandrel 32. A coaxial throughbore 46 provides fluid communication through inner mandrel 32. Inner mandrel 32 includes a male thread or pin end 42 at one end and a conventional, female threaded coupling or box end 44 at the other end. Pin end 42 is configured to be threadedly coupled to box end threads 35*b* of knocker sub 34 (FIGS. 2 and 2A). Box end 44 is designed to be threadedly coupled to sliding valve assembly 90 (FIGS. 7 and 7A) as will be described more fully hereinafter.

Inner mandrel 32 is provided with machined piston surfaces 48*a* and 48*b* to provide a smooth, piston-like surface that will sealingly and slidingly cooperate with J-tube 70 (FIGS. 6 and 6A), top sub 50 (FIGS. 4 and 4A), and outer mandrel body 30 (FIGS. 5 and 5A) as will be described more fully hereinafter. The machined piston surfaces 48*a* and 48*b* are arbitrarily defined as the surfaces on either end of inner mandrel 32 extending outwardly from J-lugs 40*a* and 40*b*.

Figure 4:
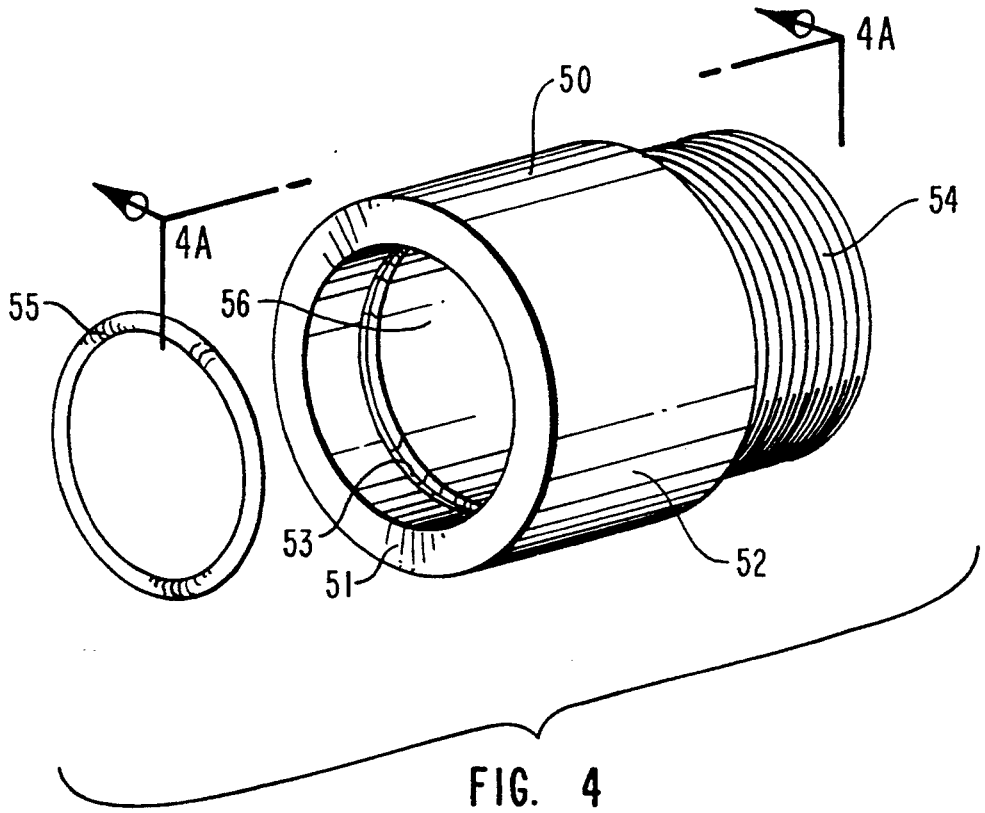
FIG. 4 is an exploded, perspective view of the top sub of the tubing unloader.
Figure 4A:
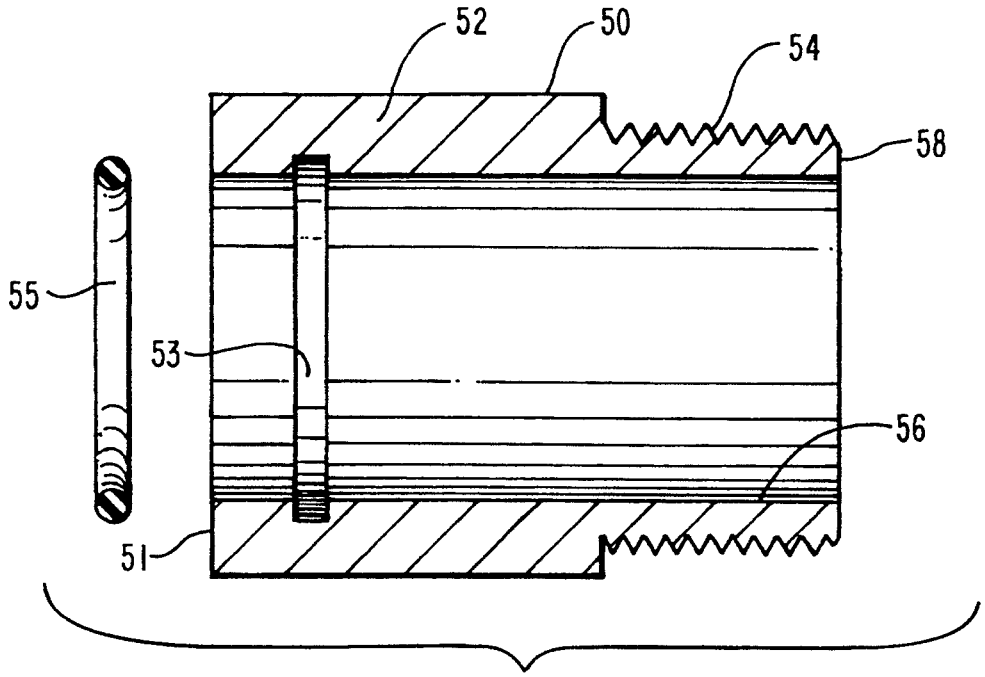
FIG. 4A is a cross-sectional view of the top sub taken along lines 4A—4A of FIG. 4.

Referring now to FIGS. 4 and 4A, the top sub is shown at 50 and includes an anvil body 52 having an annular, upper anvil face 51, a male threaded section 54, a throughbore 56, and a lower anvil face 58 designed to be struck by J-lugs 40*a* and 40*b* (FIGS. 3 and 3A) during the previously described upjarring action. An O-ring cavity 53 is provided internally in anvil body 52 to receive therein an O-ring 55. Top sub 50 is designed to threadedly engage outer mandrel body 30 (FIGS. 5 and 5A) and has a throughbore 56 to slidingly engage piston surface 48*a* of inner mandrel 32 (FIGS. 3 and 3A). O-ring 55 provides a sealing relationship between piston surface 48*a* and top sub 50.

Figure 5:
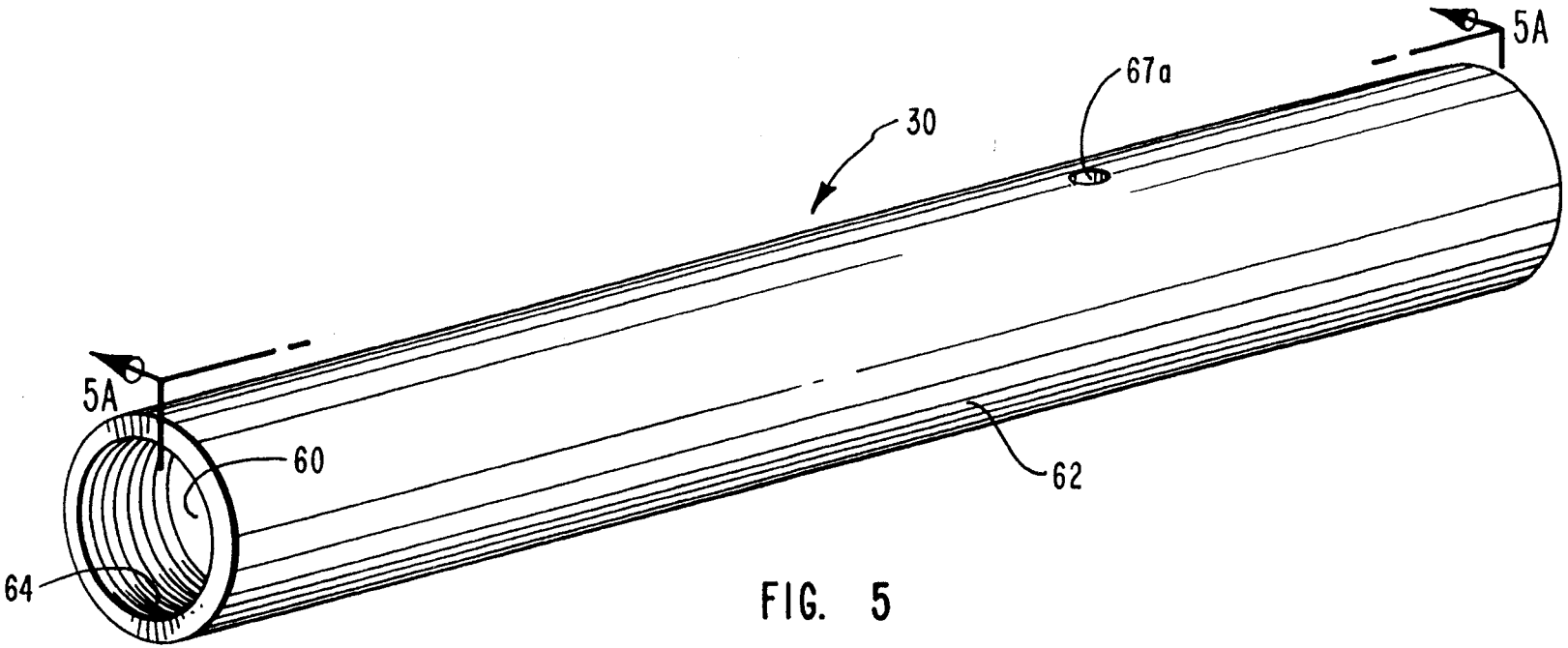
FIG. 5 is a perspective view of the outer mandrel body of the tubing unloader.
Figure 5A:
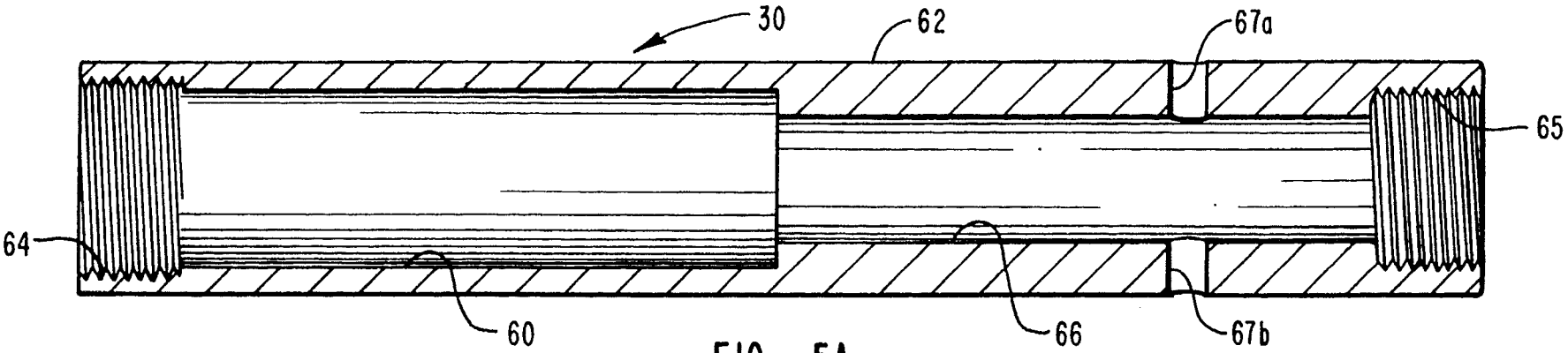
FIG. 5A is a cross-sectional view of the outer mandrel body taken along lines 5A—5A of FIG. 5.

Referring now to FIGS. 5 and 5A, outer mandrel body 30 is shown in detail and includes a cylindrical body 62 which is configured as a cylindrical section having a throughbore 66 and a recessed, J-tube cavity 60 and threads 64 formed in one end. J-tube cavity 60 is dimensionally configured to receive therein J-tube 70 (FIGS. 6 and 6A) in a tight, shrink-fit relationship. J-tube 70 is retained therein by top sub 50 being threadedly engaged by external threads 54 of top sub 50 with threads 64 of outer mandrel body 30. J-tube 70 (FIGS. 6 and 6A) includes an internal diameter 76 that corresponds with the internal diameter of throughbore 66 of outer mandrel body 30 to form a continuous cylindrical surface for slidingly receiving inner mandrel 32 (FIGS. 3 and 3A) as will be described more fully hereinafter.

Figure 8:
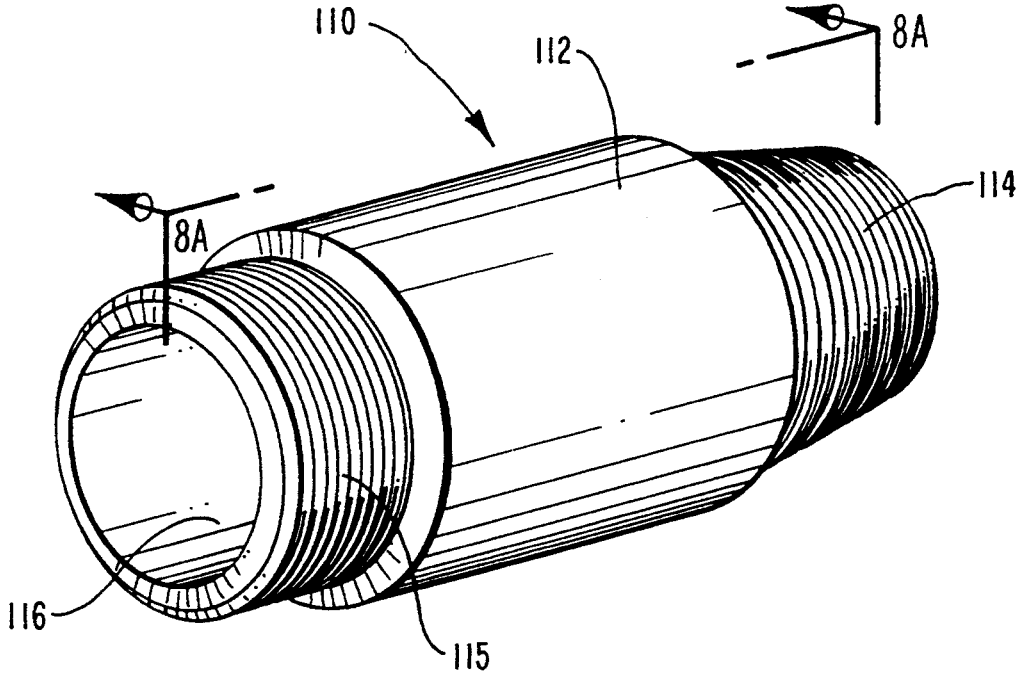
FIG. 8 is a perspective view of the bottom sub of the tubing unloader for coupling to the production tubing below the tubing unloader.
Figure 8A:
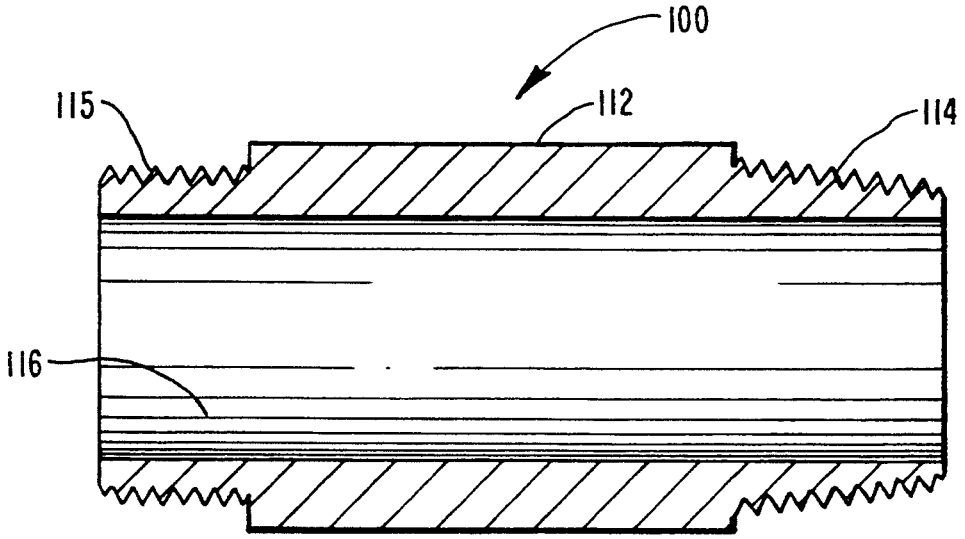
FIG. 8A is a cross-sectional view of the bottom sub taken along lines 8A—8A of FIG. 8.

Outer mandrel body 30 includes a pair of opposed drain holes 67*a* and 67*b* for the purpose of enabling tubing unloader 10 to drain crude oil 17 (FIG. 1) from production tubing 20 as will be discussed more fully hereinafter. Threads 65 threadedly connect outer mandrel body 30 to bottom sub 110 (FIGS. 8 and 8A).

Figure 6:
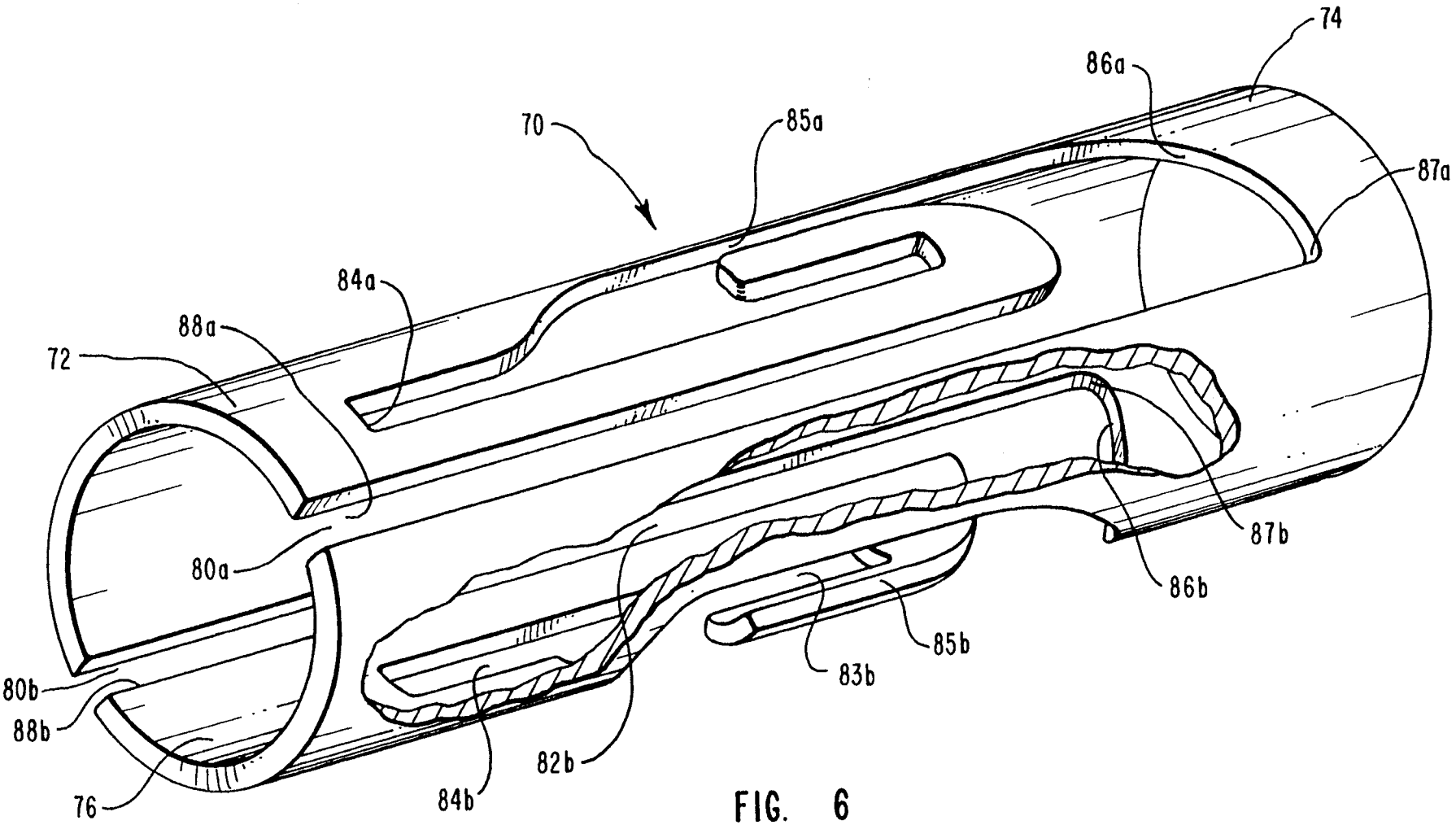
FIG. 6 is a perspective view of the J-slot sleeve of the tubing unloader shown with portions broken away to reveal additional features.
Figure 6A:
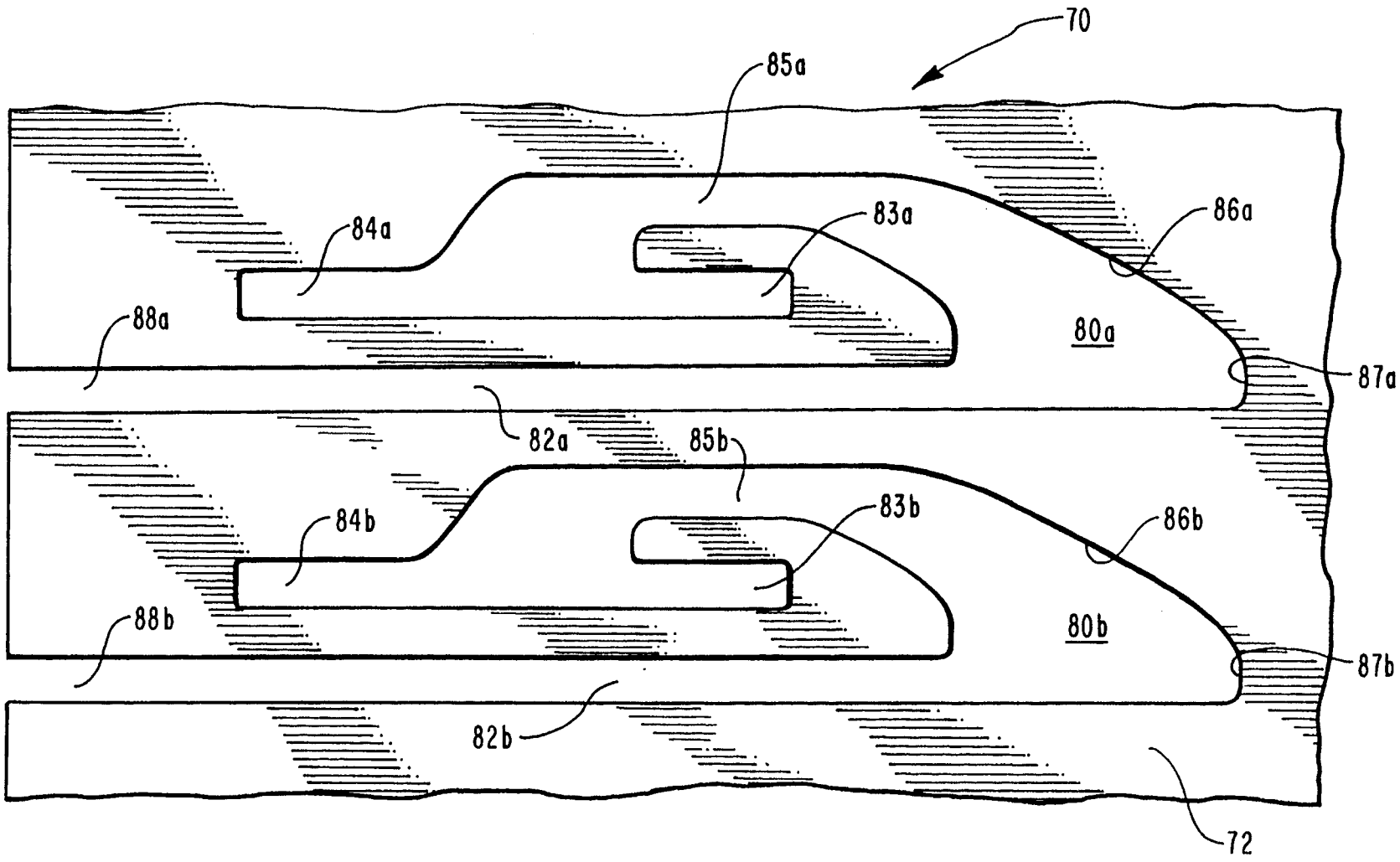
FIG. 6A is a plan view of the J-slot sleeve shown unrolled into a flat configuration to more clearly illustrate the features of the J-slots in the J-slot sleeve shown in FIG. 6.

Referring now to FIGS. 6 and 6A, J-tube 70 is shown greatly enlarged and as a sleeve 72 into which a pair of J-slots 80*a* and 80*b* are formed as open, J-shaped slots. The length of sleeve 72 corresponds to the internal length of J-tube cavity 60 (FIG. 5A). Sleeve 72 is designed to be securely held in J-tube cavity 60 by the threaded engagement of top sub 50 at threads 54 (FIGS. 4 and 4A) at threads 64 (FIGS. 5 and 5A). J-tube 70 has an external diameter 74 which is snugly received in telescoping, snug-fit relationship inside J-tube cavity 60 (FIG. 5A) and an internal diameter 76 which corresponds to the internal diameter of throughbore 66 of outer mandrel body 30 (FIG. 5A) to form a continuous, smooth cylindrical surface inside outer mandrel body 30.

Referring specifically to FIG. 6A, J-tube 70 is shown opened into a flat configuration to more clearly set forth the relationship between the two J-slots, J-slots 80*a* and 80*b*, both of which are identical in size and shape and are formed in J-tube 70 on diametrically opposite surfaces of J-tube 70. J-slot 80*a* includes an open, elongated leg 82*a* having a head 88*a* at an upper end and a foot 87*a* at a lower end. A sloping cam surface 86*a* extends between foot 87*a* and a bypass 85*a*. Bypass 85*a* is designed to direct the respective J-lug, J-lug 40*a* (FIGS. 3 and 3A), into and out of arm 84*a*. Arm 84*a* terminates downwardly in a detent 83*a*. Identical elements are found in J-slot 80*b*, namely, head 88*b*, foot 87*b*, cam surface 86*b*, bypass 85*b*, arm 84*b*, and detent 83*b*.

J-lugs 40*a* and 40*b* of inner mandrel 32 (FIGS. 3 and 3A) are designed to slidingly cooperate in J-slots 80*a* and 80*b*, respectively. The lower end of arm 84*a* terminates in a detent 83*a* while the lower end of arm 84*b* terminates in a detent 83*b*. Detents 83*a* and 83*b* serve as detents for J-lugs 40*a* and 40*b*, respectively, when tubing unloader 10 (FIG. 1) is directed into casing 12 and encounters a wax or other debris buildup (not shown) in casing 12. Importantly, detents 83*a* and 83*b* prevent tubing unloader 10 from becoming "un-jayed" in that J-lugs 40*a* and 40*b* would otherwise pass through bypasses 85*a* and 85*b* and along cam surfaces 86*a* and 86*b*, respectively. During normal operation of placing tubing unloader 10 downhole, the force of gravity pulls downwardly against outer mandrel body 30 (FIGS. 5 and 5A) causing J-tube 70 to be pulled correspondingly in a downward direction such the J-lugs 40*a* and 40*b* are held in the upper ends of the respective closed arms 84*a* and 84*b*. Upon encountering the foregoing wax, buildup, J-lugs 40*a* and 40*b* traverse downwardly through closed arms 84*a* and 84*b* into engagement with detents 83*a* and 83*b* where they are releasably held until released upon further actuation of tubing unloader 10.

During normal operation J-lugs 40*a* and 40*b* are held at the upper end of closed arms 84*a* and 84*b* under the normal tensile forces imposed on production tubing 20 (FIG. 1) as discussed hereinbefore. Relaxation of this tensile force coupled with a right-hand turn of tubing unloader 10 allows J-lugs 40*a* and 40*b* to travel outwardly through bypasses 85*a* and 85*b* and into contact with cam surfaces 86*a* and 86*b*, respectively. The sloped surface of cam surfaces 86*a* and 86*b* coupled with the downward travel of J-lugs 40*a* and 40*b* causes a corresponding rotation between outer mandrel body 30 and inner mandrel body 32 to bring J-lugs 40*a* and 40*b* into alignment with legs 82*a* and 82*b* at feet 87*a* and 87*b*. The alignment of J-lugs 40*a* and 40*b* with legs 82*a* and 82*b* allows the operator to pull upwardly on production tubing 20 (FIG. 1) and, hence, inner mandrel 32 (FIGS. 3 and 3A) to cause J-lugs 40*a* and 40*b* to traverse upwardly to head 88*a* of leg 82*a* and head 88*b* of leg 82*b*, respectively. The traverse of J-lugs 40*a* and 40*b* through legs 82*a* and 82*b* between feet 87*a* and 87*b* and heads 88*a* and 88*b* is the free stroke that is provided by tubing unloader 10. This free stroke of free point in this presently preferred embodiment of tubing unloader 10 is about 20 inches.

Figure 7:
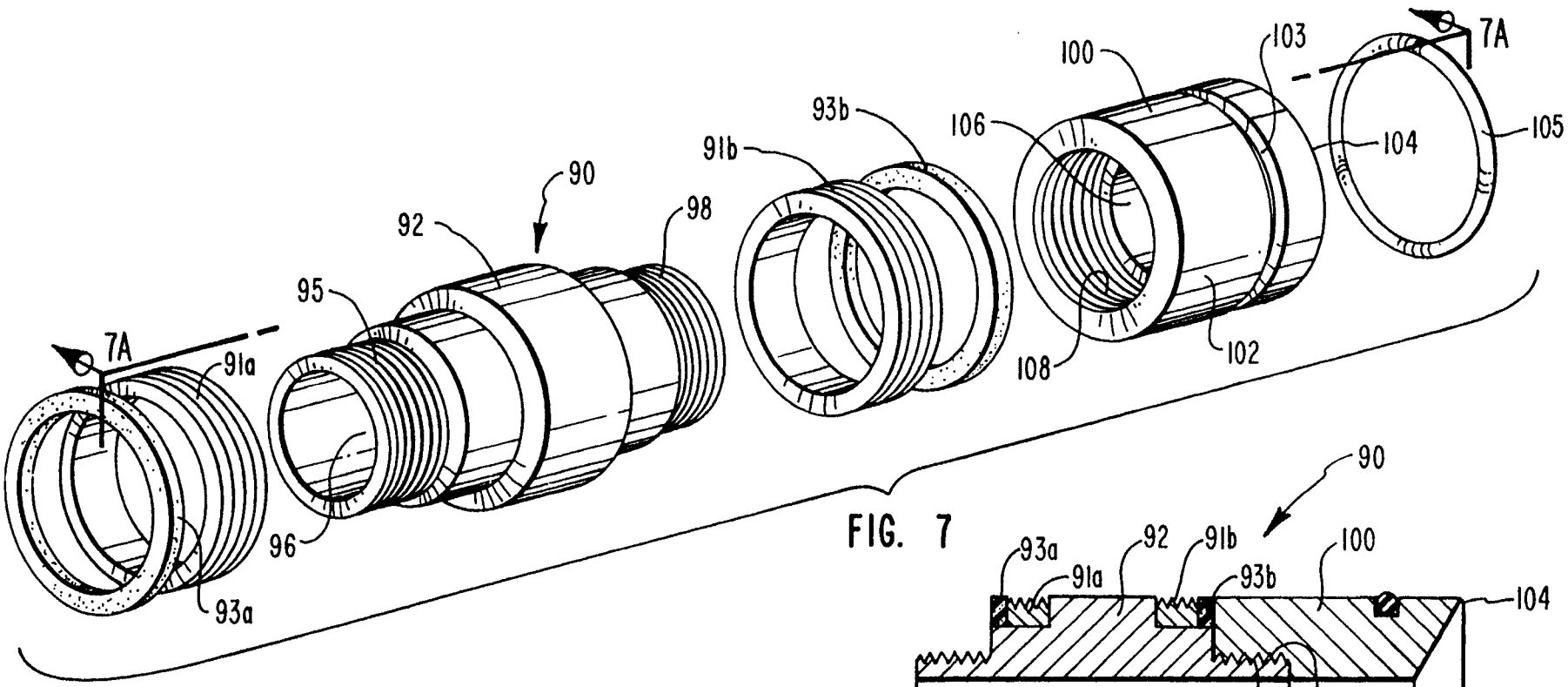
FIG. 7 is an exploded, perspective view of the sliding valve assembly and scale scraper of the tubing unloader.
Figure 7A:
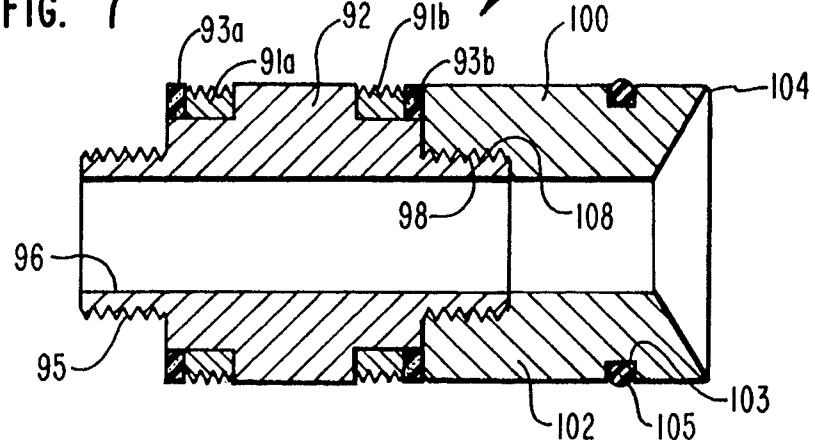
FIG. 7A is a cross-sectional view of the sliding valve assembly and scale scraper taken along lines 7A—7A of FIG. 7 with the sliding valve assembly and the scale scraper shown in the assembled configuration as mounted to the sliding valve assembly.

Referring now to FIGS. 7 and 7A, the sliding valve assembly of this invention is shown generally at 90 and includes a valve body 92 having a throughbore 96, a scale scraper 100 having a throughbore 106 and threadedly engaged to valve body 92, and a pair of O ring-like seals or, more correctly, chevron sets 91*a* and 91*b* which are held in place by a pair of retaining rings 93*a* and 93*b*, respectively. A set of male threads 95 are configured to threadedly couple sliding valve assembly 90 to threads 44 of inner mandrel 32 (FIG. 3A). Scale scraper 100 includes threads 108 which are configured to threadedly engage threads 98 on the other end of valve body 92. An O-ring 105 is received in an O-ring groove 103 in the external surface of scale scraper 100 and is designed to assist sliding valve assembly 90 in sealingly closing valve ports 67*a* and 67*b* in outer mandrel body 30 (FIGS. 5 and 5A) when sliding valve assembly 90 is telescopically inserted inside outer mandrel body 30.

Scale scraper 100 is configured to be placed on the end of sliding valve assembly 90 to secure retaining ring 93*b* in place against cheveron set 91*b* and also act as a scraper using scraper edge 104 to dislodge any scale build up (not shown) which may have accumulated on the internal surface of outer mandrel body 30 (FIGS. 5 and 5A). This scraping action will be described further in conjunction with the continued description of tubing unloader 10 as set forth hereinafter.

Referring now to FIGS. 8 and 8A, the bottom sub for tubing unloader 10 (FIG. 1) is shown generally at 110 and includes a sub body 112 having a set of threads 115 at one end, a cone-shaped threaded section or pin end 114 on the other end, and a hollow throughbore 116 extending through bottom sub 110. Threads 115 are dimensionally configured to threadedly engage bottom sub 110 to corresponding threads 65 in the end of outer mandrel body 30 (FIG. 5A). Threads 114 are convention production tubing threads and, as such are designed to threadedly couple tubing unloader 10 to production tubing section 20*a* (FIG. 1). Hollow throughbore 116 provides continuous fluid communication through coupling 110.

Figure 9:
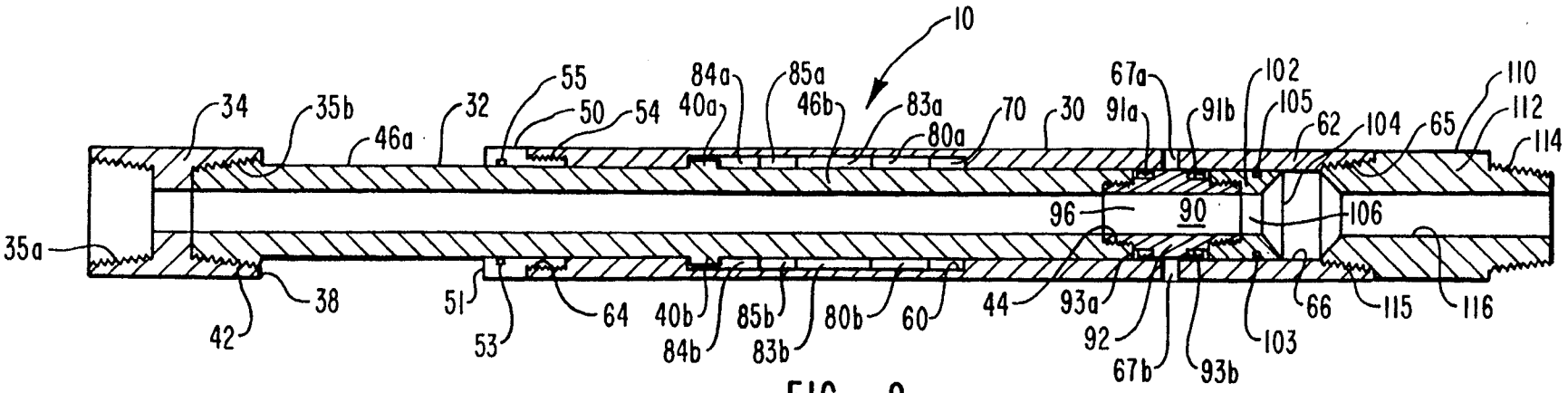
FIG. 9 is a cross-sectional view of the assembled tubing unloader shown in the normal working configuration with the sliding valve assembly in the closed position.
Figure 10:
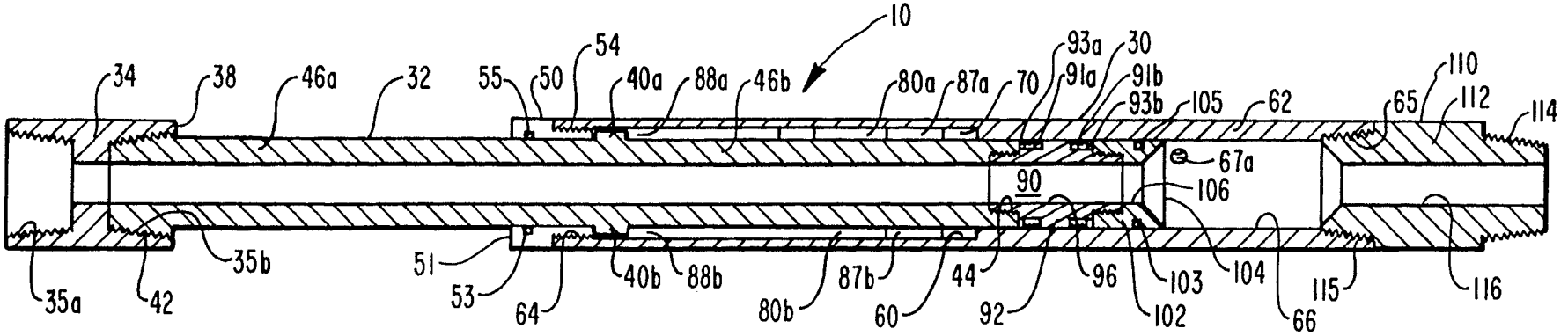
FIG. 10 is the cross-sectional view of FIG. 9 with the inner mandrel fully extended relative to the outer mandrel body and with the sliding valve in the open position and with the outer mandrel body rotated incrementally to illustrate the cooperative relationship between the J-lugs and the legs of the J-slots.

Referring now to FIGS. 9 and 10 in addition to FIGS. 1 through 8A, tubing unloader 10 is assembled by inserting J-tube 70 into sleeve cavity 60 of outer mandrel body 30. The tolerances of each are configured sufficiently close so that it is necessary to heat outer mandrel body 30 while simultaneously chilling J-tube 70. The dimensional differences created by the temperature differential acting on the coefficient of thermal expansion of each of outer mandrel body 30 and J-tube 70 allows J-tube 70 to be quickly inserted in cavity 60. Temperature equalization in combination with the close tolerances of the outer diameter of J-tube 70 with respect to the inner diameter of cavity 60 creates a firm seizure of J-tube 70 inside cavity 60.

With J-tube 70 firmly secured inside cavity 60, outer mandrel body 30 is ready to receive inner mandrel 32. Sliding valve assembly 90 is first assembled by mounting cheveron sets 91*a*and 91*b* to valve body 92 and placing retaining rings 93*a* and 93*b* (FIGS. 7 and 7A), respectively, thereon. O-ring 105 is then mounted in O-ring groove 103 and scale scraper 100 is threadedly secured to sliding valve body 92 by engaging threads 108 to threads 98. Sliding valve assembly 90 is then mounted to the end of internal mandrel 32 by engaging threads 95 with threads 44.

The combined assembly of inner mandrel 32, sliding valve assembly 90, and scale scraper 100 is designed to be telescopically received in outer mandrel body 30 with J-lugs 40*a* and 40*b* slidingly engaged in J-slots 80*a* and 80*b*, respectively. Sliding valve assembly 90 is also designed to sealingly close drain ports 67*a* and 67*b* as a function of the location of J-lugs 40*a* and 40*b* in arms 84*a* and 84*b* of their respective J-slots, J-slots 80*a* and 80*b*.

Inner mandrel 32 is releasably locked inside outer mandrel body 30 by the threaded engagement of top sub 50 to outer mandrel body 30 by engaging threads 54 of top sub 50 with threads 64 of outer mandrel body 30. Knocker sub 34 is then mounted to inner mandrel 32 upon threaded engagement between threads 36*b* and threads 42. The upper end of knocker sub 34 presents a box threaded coupling with threads 35*a* which engage corresponding threads (not shown) on the bottom of production tubing 20. Correspondingly, bottom sub 110 is mounted to the lower end of outer mandrel body 30 by threaded engagement between threads 115 and threads 65 and provides a pin end coupling with threads 114. Accordingly, tubing unloader 10 is now configured to be selectively incorporated into production tubing 20.

Referring now specifically to FIG. 9, tubing unloader 10 is shown in a cross-sectional view as fully assembled in its operative position in production tubing 20. In particular, sliding valve assembly 90 is shown in its occluding position over side ports 67*a* and 67*b*. Further, J-lugs 40*a* and 40*b* are held against the upper ends of arms 84*a* and 84*b*, respectively, which position holds sliding valve assembly 90 in its occluding position over side ports 67*a* and 67*b* while simultaneously allowing the necessary tensile forces to be applied on production tubing 20 during operation of rod pump 16 as has been described hereinbefore.

Referring now specifically to FIG. 10, tubing unloader 10 is shown in its unloading position, namely, sliding valve assembly 90 has been pulled away from its occluding position across side port 67*a*. This is achieved by telescoping and rotating inner mandrel 32 into outer mandrel body 30 until J-lugs 40*a* and 40*b* clear detents 83*a* and 83*b*. J-lugs 40*a* and 40*b* pass through by passes 85*a* and 85*b* and engage cam surfaces 86*a* and 86*b*, respectively. Cam surfaces 86*a* and 86*b* cause inner mandrel 32 to be rotated incrementally until J-lugs 40*a* and 40*b* are received into legs 82*a* and 82*b*, respectively. Inner mandrel 32 is then pulled outwardly from outer mandrel body 30 until J-lugs 40*a* and 40*b* are brought into abutment with the bottom edge of top sub 50. J-lugs 40*a* and 40*b* now reside in heads 88*a* and 88*b* of J-slots 80*a* and 80*b*, respectively. J-lugs 40*a* and 40*b* are free to travel the full, free stroke distance of legs 82*a* and 82*b* by travelling from heads 88*a* and 88*b* to feet 87*a* and 87*b*, respectively. This free stroke distance is the feature that readily adapts tubing unloader 10 to the creation of the free point and the down jar or up jar forces described hereinbefore.

The Method

Referring again to all of FIGS. 1–10, tubing unloader 10 is designed to be incorporated into production tubing 20, preferably one or two lengths of production tubing 20*a* above rod pump 16. Tubing anchor 18 provides an anchor mechanism for applying a preselected tensile force to production tubing 20 including tubing unloader 10 and rod pump 16. The foregoing tensile force securely engages J-lugs 40*a* and 40*b* in arms 84*a* and 84*b* of J-slots 80*a* and 80*b*, respectively. With this engagement between inner mandrel 32 and outer mandrel body 30, sliding valve assembly 90 is held in sealing relationship over drain ports 67*a* and 67*b*.

Operation of tubing unloader 10 to open drain ports 67*a* and 67*b* is accomplished by releasing the forgoing tensile force and lowering inner mandrel 32 with respect to outer mandrel body 30 while at the same time imparting a slight left hand turn to production tubing 20 to cause J-lugs 40*a* and 40*b* to slide past detents 83*a* and 83*b* into and through bypasses 85*a* and 85*b* and into contact with cam surfaces 86*a*, 86*b*, respectively. This motion places each of J-lugs 40*a* and 40*b* in the corresponding foot, feet 87*a* and 87*b*, of each of the legs 82*a* and 82*b*, respectively, thereby assuring proper alignment between respective J-lugs 40*a* and 40*b* with legs 82*a* and 82*b*. Raising production tubing 20 incrementally (approximately 20 inches, 50.8 cm) pulls J-lugs 40*a* and 40*b* upwardly through the respective legs 82*a* and 82*b* until J-lugs 40*a* and 40*b* are received in heads 88*a* and 88*b* where they are stopped by top sub 50.

The downward movement of inner mandrel 32 inside outer mandrel body 30 causes scraper 110, or more particularly, scraper edge 104, to scrape any scale, corrosion, or other accumulation of debris (not shown) from this intervening internal surface of throughbore 66. The upward movement of inner mandrel 32 relative to outer mandrel body 30 removes sliding valve assembly 90 away from closure of drain ports 67*a* and 67*b* allowing crude oil 17 to drain from all of production tubing 20 above tubing unloader 10. In the event scale, etc. (not shown) tends to plug drain ports 67*a* and 67*b*, inner mandrel 32 can be lowered downwardly into outer mandrel body 30 causing scraping edge 104 to remove any obstruction tending to plug drain ports 67*a* and 67*b*. Clearly, of course, the likelihood of this latter step being required is remote although, as a matter of additional convenience, this feature is readily available.

The complete drainage of production tubing 20 places the entire production string in condition for retrieval from oil well casing 12. The first step is to lower production tubing 20, hence inner mandrel 32 into outer mandrel body 30, until J-lugs 40*a* and 40*b* rest in the respective foot 87*a* and 87*b* of J-slots 80*a* and 80*b*. Additional lowering of production tubing 20 imposes a set down weight on tubing anchor 18. Conventionally, this set down weight and right-hand rotation should be sufficient to cause tubing anchor 18 to release from engagement with oil well casing 12. However, all too frequently, tubing anchor 18 will not release.

The next step is to apply a strong, upwardly directed overpull of about 50,000 pounds force against tubing anchor 18 in an attempt to shear the shear pins (not shown) in tubing anchor 18. This pulling force raises inner mandrel 32 inside outer mandrel body 30 until J-lugs 40*a* and 40*b* are in engagement against top sub 50. Again, and all too frequently, this overpull is inadequate to cause tubing anchor 18 to either release or the shear pins (not shown) therein to shear. Under these circumstances a sharp down jar combined with a sharp up jar will almost always cause tubing anchor 18 to release.

The down jar is created by pulling the inner mandrel upwardly through the free space created by the linear traverse of J-lugs 40*a* and 40*b* through the respective legs 82*a* and 82*b* until J-lugs 40*a* and 40*b* are brought into engagement with the bottom face of top sub 50. At this time an additional 10,000 pounds of tensile force is pulled on production tubing causing a slight elongation of production tubing due to the tensile force acting on the elasticity inherent in the several thousand feet of production tubing 20 extending downwardly in oil well casing 12 to tubing anchor 18. A sudden release of this tensile force coupled with the force of gravity causes inner mandrel 32 to telescopically traverse into outer mandrel body 30 (as guided by J-lugs 40*a* and 40*b* in legs 82*a* and 82*b*, respectively) until the bottom of knocker sub 34 sharply strikes anvil face 51 of top sub 50. This force is transmitted downwardly through outer mandrel body 30, lower production tubing sections 20*a* and 20*b* along with rod pump 18 and into tubing anchor 18. The application of this sharp downward force or down jar can be repeated as desired.

The sharp, upwardly directed force or up jar is produced against tubing anchor 18 by pulling production tubing 20 upwardly until tubing unloader 10 is fully extended with J-lugs 40*a* and 40*b* held firmly against the bottom surface of top sub 50. A first tensile force of 10,000 pounds is then pulled on production tubing 20 at which point production tubing 20 is suitably marked. An additional 20,000 pound tensile force is then pulled on production tubing 20. This additional tensile force stretches production tubing within its elastic limit so that the original mark on production tubing 20 is raised a measurable distance above its original position. In this configuration of overpull, production tubing 20 is quickly released and then caught again at the original mark so as to cause the combination of release of the second tensile force (the 20,000 pound force overpull) and gravitational force on all of production tubing 20 to cause J-lugs 40*a* and 40*b* to traverse a portion of the free stroke of legs 82*a* and 82*b*, respectively, until the inherent elasticity in production tubing 20 stops the downward traverse. The residual 10,000 pound tensile force then combines with the elasticity of production tubing 20 to cause J-lugs 40*a* and 40*b* to spring upwardly to sharply strike against the bottom face of top sub 50. This sharp upward force or up jar is transmitted through outer mandrel body 30, and production tubing sections 20*a* and 20*b* into tubing anchor 18.

This unique capability of allowing the operator (not shown) to selectively apply these directional forces is unique with tubing unloader 10. Further, torsional forces can be applied through tubing unloader 10 also because of the unique relationship of J-lugs 40*a* and 40*b* with J-slots 80*a* and 80*b*, respectively.

Another important feature of tubing unloader 10 is that servicing or even changes in the initial configuration of tubing unloader 10 can be made at well head 23. This is done by removing top sub 50 from outer mandrel body 30 and pulling all of inner mandrel 32, sliding valve assembly 90, and scale scraper 100 from outer mandrel body 30. Scale scraper 100 is removed from one end of sliding valve assembly 90 and inner mandrel 32 from the other end. Retaining rings 93*a* and 93*b* are then removed to allow replacement of cheveron sets 91*a* and 91*b*. Cheveron sets 91*a* and 91*b* are selected from commercially available cheveron sets 91*a* and 91*b* having the desired thermal and chemical properties to resist the downhole conditions in oil well casing 12 as well as that of crude oil 17. O-rings 55 and 105 may also be replaced with O-rings having the desired characteristics.

Sliding valve assembly 90 is then reassembled and mounted to the end of inner mandrel 32 while scale scraper 100 is mounted to the opposite end of sliding valve assembly 90. Inner mandrel 32 with sliding valve assembly 90 and scale scraper 100 on the end thereof is telescopically inserted into outer mandrel body 30 with sliding valve assembly 90 being received in sliding and sealing relationship within inner cavity 60 of outer mandrel body 30. J-lugs 40*a* and 40*b* are inserted into J-slots 80*a* and 80*b* with top sub 50 securing inner mandrel 32 to outer mandrel body 30 thereby releasably locking J-lugs 40*a* and 40*b* in J-slots 80*a* and 80*b*. The foregoing features provide tubing unloader 10 with the features of being easily assembled and serviced while at the same time providing tubing unloader 10 with the capability of enabling the operator (not shown) to selectively apply a steady pulling force, a torsional force, a sharp downward force, or a sharp upward force as well as free point use.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A tubing unloader for draining liquid from a production tubing comprising:

an outer mandrel body comprising a first, hollow cylindrical body having a lower end, an upper end, and side port means in a sidewall of said cylindrical body, said side port means comprising a drain for draining said liquid from said outer mandrel body, said lower end comprising a first bottom sub means for coupling said lower end of said outer mandrel body to said production tubing, said outer mandrel body including a first internal diameter adjacent said lower end and a milled section having a second internal diameter adjacent said upper end, said second internal diameter being incrementally larger than said first internal diameter;

a J-sleeve telescopically received in said milled section and a top sub threadedly engaged to said upper end of said outer mandrel body to secure said J-sleeve in said milled section, said J-sleeve having a third internal diameter corresponding to said first internal diameter of said outer mandrel body, said J-sleeve including a pair of diametrally opposed J-slots, said J-slots comprising a leg having an open end adjacent said upper end and a closed arm spaced from and parallel to said leg with a transverse section interconnecting said closed arm with said leg;

an inner mandrel telescopically receivable inside said outer mandrel body, said inner mandrel comprising a first end and a second end, said first end comprising an anvil means for coupling said inner mandrel to said production tubing;

a sliding valve means mounted to said second end for selectively opening and closing said side port means; and a pair of J-lugs on said inner mandrel, each of said J-lugs being configured as a raised boss extending outwardly on opposite sides of said inner mandrel, said J-lugs slidingly engaging said J-slots when said inner mandrel is telescopically received in said outer mandrel body said J-slots limiting movement of said inner mandrel relative to said outer mandrel body and thereby providing an interlock means for slidably interlocking said inner mandrel inside said outer mandrel body.

2. The tubing unloader defined in claim 1 wherein said sliding valve means is held in a closed position over said side port means when said J-lugs are in said arms of said J-slots.

3. The tubing unloader defined in claim 1 wherein said leg of said J-slot comprises a limited free travel between said inner mandrel and said outer mandrel body.

4. A tubing unloader for draining liquid from a production tubing comprising:

an outer mandrel body comprising a first, hollow cylindrical body having a lower end, an upper end, and side port means in a sidewall of said cylindrical body, said side port means comprising a drain for draining said liquid from said outer mandrel body, said lower end comprising a first bottom sub means for coupling said lower end of said outer mandrel body to said production tubing, said outer mandrel body including a first internal diameter adjacent said lower end and a milled section having a second internal diameter adjacent said upper end, said second internal diameter being incrementally larger than said first internal diameter, an inner mandrel telescopically receivable inside said outer mandrel body, said inner mandrel comprising a first end and a second end, said first end comprising an anvil means for coupling said inner mandrel to said production tubing, said second end comprising a sliding valve means for selectively opening and closing said side port means;

interlock means for slidably interlocking said inner mandrel inside said outer mandrel body, said interlock means comprising a J-sleeve telescopically received in said milled section and a top sub threadedly engaged to said upper end of said outer mandrel body to secure said J-sleeve in said milled section, said J-sleeve having a third internal diameter corresponding to said first internal diameter of said outer mandrel body, said J-sleeve comprising a pair of diametrally opposed J-slots, said J-slots comprising a leg having an open end adjacent said upper end and a closed arm spaced from and parallel to said leg with a transverse section interconnecting said closed arm with said leg, said inner mandrel comprising a pair of J-lugs, each J-lug configured as a raised boss extending outwardly on opposite sides of said inner mandrel, said J-lugs being configured to be slidingly engaged in said J-slots when said inner mandrel is telescopically received in said outer mandrel body said J-slots limiting movement of said inner mandrel relative to said outer mandrel body, said sliding valve means being held in a closed position over said side port means when said J-lugs are in said arms of said J-slots, said leg of said J-slot comprising a limited free travel between said inner mandrel and said outer mandrel body, said limited free travel comprising a down jar means for imparting a down jar on said outer mandrel body whereby a first predetermined force of overpull is exerted on said production tubing and released to produce said down jar on said outer mandrel body.

5. The tubing unloader defined in claim 4 wherein said limited free travel comprises an up jar means for imparting an up jar on said outer mandrel body whereby said first predetermined force of overpull is exerted on said production tubing, said production tubing being marked at said first overpull and a second predetermined force is exerted on said production tubing beyond said first predetermined force, said production tubing being released and caught at said mark, said limited free travel thereby creating said up jar on said outer mandrel body.

6. The tubing unloader defined in claim 4 wherein said sliding valve means includes a scale scraper for scraping scale from said first internal diameter as said inner mandrel is telescopically reciprocated inside said outer mandrel body.

7. A tubing unloader for selectively draining liquid from a production tubing into which said tubing unloader is incorporated comprising:

an upper knocker sub for coupling a top end of said tubing unloader into a production tubing;

an inner mandrel coupled at a first end to said knocker sub, said inner mandrel having a J-lug means protruding outwardly from an external surface of said inner mandrel;

an outer mandrel body for telescopically receiving said inner mandrel in a slide-fit relationship, said outer mandrel body including side port means for draining said liquid, said outer mandrel body including J-slot means guiding said J-lug means of said inner mandrel;

a top anvil releasably mounted to said outer mandrel body, said top anvil securing said inner mandrel inside said outer mandrel body;

a sliding valve means on said inner mandrel, said sliding valve means selectively closing said side ports in a first position of said J-lugs in said J-slots and selectively opening said side ports in a second position of said J-lugs in said J-slots;

a scale scraper means on said sliding valve means for scraping scale from said outer mandrel body; and a lower tubing coupling means for coupling a lower end of said outer mandrel body to said production tubing.

8. The tubing unloader defined in claim 7 wherein said J-slot means comprises at least one J-slot having a shorter, closed arm and a longer, open leg, said open leg being selectively closed by said top anvil, said open leg providing a free stroke to said tubing unloader, said free stroke comprising the length of said open leg.

9. A method of draining liquid from a production tubing comprising the steps of:

obtaining an outer mandrel body as a hollow cylindrical body having side ports in a sidewall of said hollow cylindrical body, said side ports comprising a drain;

preparing a hollow inner mandrel to be telescopically received in said outer mandrel body in sliding relationship;

mounting a sliding valve means on one end of said inner mandrel for selectively occluding said side ports in said outer mandrel body as a function of the relative position of said inner mandrel in said outer mandrel body;

forming a J-lug means on an external surface of said inner mandrel;

configuring a J-slot means on an internal surface of said outer mandrel body;

providing a free stroke in said tubing unloader by forming an elongated leg in said J-slot means, said elongated leg being closed by said top anvil;

interlocking said J-lug means in said J-slot means in sliding relationship thereby controlling the relative positional relationship between said inner mandrel and said outer mandrel body;

locking said inner mandrel in said outer mandrel body by mounting a top anvil to said outer mandrel body thereby forming a tubing unloader;

coupling said tubing unloader in a production tubing with a knocker sub;

imparting a down jar on said outer mandrel body by overpulling said production tubing and dropping said production tubing thereby causing said J-lug means to traverse said elongated leg and imparting said down jar on said outer mandrel body; and draining said production tubing by moving said sliding valve means away from said side ports by manipulating said inner mandrel relative to said outer mandrel body by selectively moving said J-lug means in said J-slot means.

10. The method defined in claim 9 wherein said providing step further comprises imparting an up jar on said outer mandrel body by applying a first overpull force on said production tubing thereby pulling said J-lug means against said top anvil and marking said production tubing, said up jar being created by imposing a second overpull force on said production tubing greater than said first overpull force and dropping said production tubing while immediately catching said production tubing at said mark thereby causing said J-lug means to travel downwardly into said open leg an incremental distance and then sharply return and strike said top sub thereby creating an up jar against said outer mandrel body.

* * * * *